US011554394B2

(12) United States Patent
Baker-Anderson

(10) Patent No.: US 11,554,394 B2
(45) Date of Patent: Jan. 17, 2023

(54) CLOSED-CONTAINER CLEANER

(71) Applicant: John Jeffrey Baker-Anderson, Minneapolis, MN (US)

(72) Inventor: John Jeffrey Baker-Anderson, Minneapolis, MN (US)

( * ) Notice: Subject to any disclaimer, the term of this patent is extended or adjusted under 35 U.S.C. 154(b) by 99 days.

(21) Appl. No.: 17/010,508

(22) Filed: Sep. 2, 2020

(65) Prior Publication Data

US 2021/0213496 A1 Jul. 15, 2021

Related U.S. Application Data

(60) Provisional application No. 62/961,551, filed on Jan. 15, 2020.

(51) Int. Cl.
*B08B 9/08* (2006.01)
*A46B 9/02* (2006.01)
*B08B 1/00* (2006.01)

(52) U.S. Cl.
CPC ..... *B08B 9/0808* (2013.01); *A46B 9/026* (2013.01); *B08B 1/002* (2013.01); *B08B 9/08* (2013.01); *A46B 2200/3006* (2013.01)

(58) Field of Classification Search
CPC . A46B 9/026; A46B 9/028; A46B 2200/3006; B08B 9/0808; B08B 9/0817
See application file for complete search history.

(56) References Cited

U.S. PATENT DOCUMENTS 2,478,961 A * 8/1949 Wortham ..... B08B 9/057 15/104.061
3,231,925 A * 2/1966 Conder ..... A46B 9/04 401/268
3,651,530 A * 3/1972 Schultz ..... B08B 9/0552 15/104.061
4,383,346 A * 5/1983 Bochinski ..... B08B 9/0552 15/104.061
4,406,031 A * 9/1983 Eimer ..... B08B 9/0552 15/104.061
5,985,042 A * 11/1999 Fiedler ..... B08B 1/00 15/244.4
6,129,092 A * 10/2000 Mondi ..... G06F 3/039 15/210.1
D540,896 S * 4/2007 Chernick ..... D21/714
D561,277 S * 2/2008 Chernick ..... D21/707
D568,424 S * 5/2008 Nelson ..... D21/707
D716,054 S * 10/2014 Sawicki ..... D4/128
D776,478 S * 1/2017 Steel ..... D7/376
2008/0263795 A1* 10/2008 Chow ..... B08B 9/055 15/104.062
2009/0194136 A1 8/2009 Yamashiro, Jr. et al.
2016/0073770 A1 3/2016 Stokes

FOREIGN PATENT DOCUMENTS

JP 2001259559 A 9/2001
JP 2011512242 A 4/2011
KR 20090011316 U 11/2009

* cited by examiner

*Primary Examiner* — Randall E Chin
(74) *Attorney, Agent, or Firm* — Faegre Drinker Biddle & Reath LLP

(57) ABSTRACT

Various aspects of the present disclosure are directed toward apparatuses, systems, and methods that include a cleaning assembly for a container. The cleaning assembly may include a base; a plurality of protrusions extending from different locations about a circumference of the base; and a porous material arranged about the circumference of the base and between the plurality of protrusions.

18 Claims, 4 Drawing Sheets

CLOSED-CONTAINER CLEANER

CROSS-REFERENCE TO RELATED APPLICATION

This application claims priority to Provisional Application No. 62/961,551, filed Jan. 15, 2020, which is herein incorporated by reference in its entirety.

FIELD

Various aspects of the present disclosure described herein generally relate to cloths, pads, sponges, or wipes and, more particularly, to a multi-layered cleaning implement suitable for wiping, cleaning, or scouring an interior of a bottle or container.

BACKGROUND

Cleaning of containers, such as reusable bottles, transportable coffee mugs, and the like, can be difficult using traditional cleaning implements such as washcloths, sponges or brushes. For instance, attributes of the container to be cleaned, such as a narrow opening, a tall form factor, and the presence of crevices of the interior surface of the container, can make parts of the interior surface hard to reach. Sponges and washcloths that are held in the hand may not reach all interior surfaces of the container since the operator's hand may not fit inside the container. Brushes or sponges-on-sticks having a shaft or extended handle may help in this regard, but may nonetheless have difficulty reaching certain portions of the interior surface of a container having a narrow neck, such as the shoulder portions.

Moreover, the use of traditional sponges and brushes typically involves two hands, with one hand holding the container and the other manipulating the cleaning implement, which may present difficulty for those operators who have no or limited use of one hand. In many cases, there are sticky food particles, residue, or bacteria stuck to the interior surfaces and crevices of the container, that may call for a greater level of force to breakdown and clean than can be reasonably applied using certain cleaning implements having soft surfaces or flexible shafts.

SUMMARY

In Example 1, a cleaning assembly for a container includes a base; a plurality of protrusions extending from different locations about a circumference of the base, the plurality of protrusions each tapering inwardly toward a distal end thereof; and a porous material arranged about the circumference of the base and between the plurality of protrusions.

In Example 2, further to the cleaning assembly of Example 1, at least two of the plurality of protrusions are arranged on a first side of the circumference of the base and at least four of the plurality of protrusions are arranged on an opposing second side of the circumference of the base.

In Example 3, further to the cleaning assembly of Example 1, the base and the plurality of protrusions are formed of a common material.

In Example 4, further to the cleaning assembly of Example 3, the base and the plurality of protrusions are formed of silicone.

In Example 5, further to the cleaning assembly of Example 1, the porous material has a greater flexibility than the base and the plurality of protrusions.

In Example 6, further to the cleaning assembly of Example 1, each of the plurality of protrusions are cone shaped.

In Example 7, further to the cleaning assembly of Example 1, the base includes an outwardly extending lip portion configured to support the porous material.

In Example 8, further to the cleaning assembly of Example 1, the base includes a first material and a second material, and the second material is of a greater weight than the first material.

In Example 9, further to the cleaning assembly of Example 8, the second material is arranged within and surrounded by the first material.

In Example 10, a cleaning assembly for a container includes a base; a plurality of protrusions extending from different locations about a circumference of the base and configured to remove particles from the container, the plurality of protrusions each tapering inwardly toward a distal end thereof; and a porous material arranged about the circumference of the base and between the plurality of protrusions and configured to scour the container or capture the particles; and a weight arranged within the base configured to facilitate contact between the plurality of protrusions and the porous material and the container.

In Example 11, further to the cleaning assembly of Example 10, a lesser number of the plurality of protrusions are arranged on a first side of the circumference of the base than on an opposing second side of the circumference of the base.

In Example 12, further to the cleaning assembly of Example 10, the base and the plurality of protrusions are formed of a common material.

In Example 13, further to the cleaning assembly of Example 12, the base and the plurality of protrusions are formed of silicone.

In Example 14, further to the cleaning assembly of Example 10, the porous material has a greater flexibility than the base and the plurality of protrusions.

In Example 15, further to the cleaning assembly of Example 10, each of the plurality of protrusions are cone shaped.

In Example 16, a method of cleaning a container includes arranging a cleaning assembly within a container, the cleaning assembly comprising a base, a plurality of protrusions extending from different locations about a circumference of the base, the plurality of protrusions each tapering inwardly toward a distal end thereof, and a porous material arranged about the circumference of the base and between the plurality of protrusions; and shaking the container to facilitate contact between the cleaning assembly and the container to remove particles from the container.

In Example 17, further to the method of Example 16, a lesser number of the plurality of protrusions are arranged on a first side of the circumference of the base than on an opposing second side of the circumference of the base.

In Example 18, further to the method of Example 16, the base and the plurality of protrusions are formed of silicone.

In Example 19, further to the method of Example 16, the porous material has a greater flexibility than the base and the plurality of protrusions.

In Example 17, further to the method of Example 16, each of the plurality of protrusions are cone shaped.

The foregoing Examples are just that, and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Figure 1:
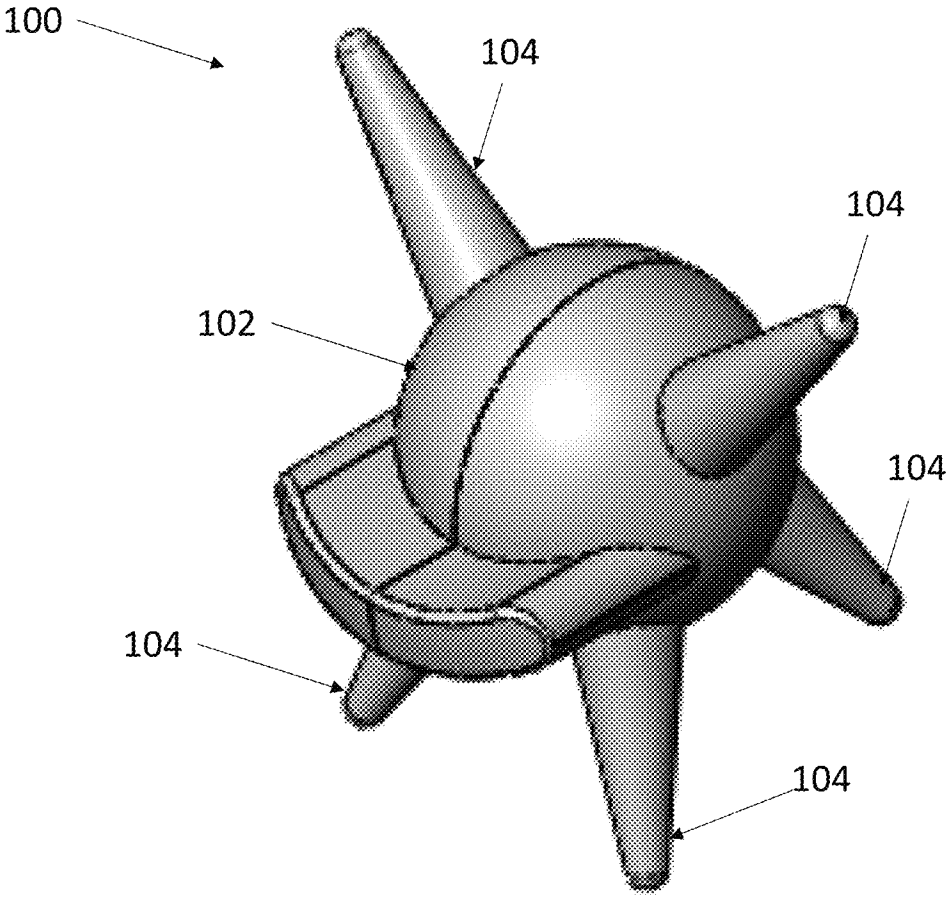
FIG. 1 is a perspective view of an example cleaning assembly, in accordance with various aspects of the present disclosure.

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error, differences in measurement and/or manufacturing equipment calibration, human error in reading and/or setting measurements, minor adjustments made to optimize performance and/or structural parameters in view of differences in measurements associated with other components, particular implementation scenarios, imprecise adjustment and/or manipulation of objects by a person or machine, and/or the like, for example. In the event it is determined that individuals having ordinary skill in the relevant arts would not readily ascertain values for such reasonably small differences, the terms "about" and "approximately" can be understood to mean plus or minus 10% of the stated value.

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

Various aspects of the present disclosure are directed toward a cleaning assembly that may be particularly useful in cleaning a closed-container (e.g., drink bottles, capped coffee mugs, reusable food-storage containers, flasks, thermoses). The cleaning assemblies, as discussed in further detail below, may include one or more protrusions and a sponge or porous material in between the protrusions. As a result, the cleaning assembly may include multiple cleaning surfaces. In certain instances, the protrusions may clean a container on a macro-basis to remove larger particulate, and the sponge or porous material may finely scrub the container to remove smaller particulate. The sponge or porous material may include open-cell foam, woven twine, natural or synthetic wool, elastomer (e.g., rubber, silicone, thermoplastic). The cleaning surfaces may be smooth or abrasive, or it may include a combination of different surface properties FIG. 1 is a perspective view of an example cleaning assembly 100, in accordance with various aspects of the present disclosure. The cleaning assembly 100 may include a base 102 and a plurality of protrusions 104. In certain instances, the base 102 may be substantially spherical with the plurality of protrusions 104 extending from the base 102. In addition, the plurality of protrusions 104 may extend from different locations about a circumference of the base 102 as is shown in FIG. 1. Further and as shown, the plurality of protrusions 104 may be tapering inwardly toward a distal end thereof.

In certain instances, the protrusions 104 may be unequally spaced on a first (top) side of the base 102 relative to another side of the base 102. For example, there may be less protrusions 104 on a first side of a base than on a second side of the base 102 as is shown in FIG. 1. In certain instances, at least two of the plurality of protrusions 104 are arranged on a first side of the circumference of the base and at least four of the plurality of protrusions 104 are arranged on an opposing second side of the circumference of the base.

The base 102 and the plurality of protrusions 104, in certain instances, may be formed of a common material. The base 102 and the plurality of protrusions 104 may be silicone, polyurethane, or a thermoplastic (for example). In addition, each of the plurality of protrusions 104 may be cone shaped, pyramid shaped, spherical, conical, or any other similar shape.

Figure 2:
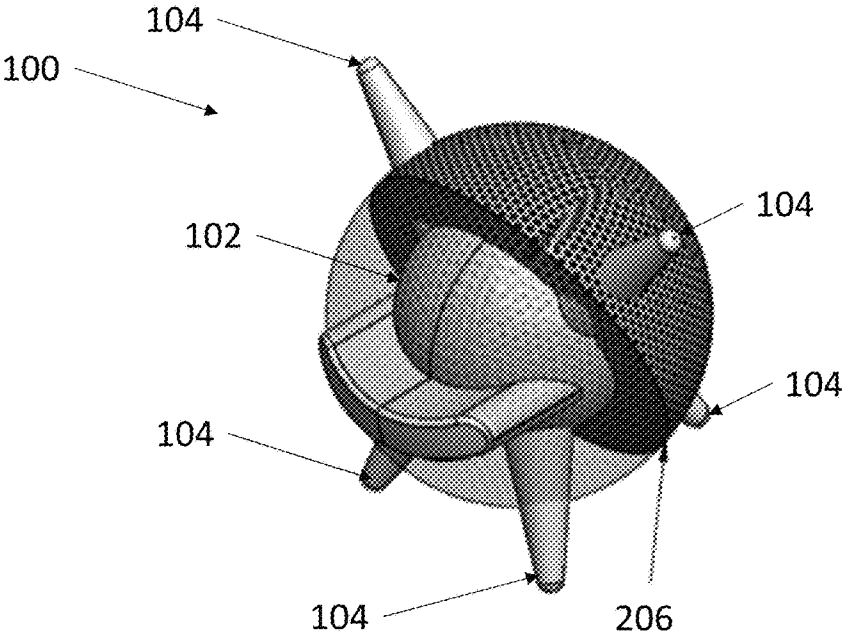
FIG. 2 is a partial cutaway perspective view of an example cleaning assembly, in accordance with various aspects of the present disclosure.

FIG. 2 is a partial cutaway perspective view of an example cleaning assembly 100, in accordance with various aspects of the present disclosure. The cleaning assembly 100 may include a base 102 and a plurality of protrusions 104. The cleaning assembly 100 also includes a porous material 206. The porous material 206, which may be a sponge structure, is about the circumference of the base 102 and between the plurality of protrusions 104.

In certain instances, the porous material 206 has a greater flexibility than the base 102 and the plurality of protrusions 104. In certain instances, the protrusions 104 are configured to remove particles from the container and the porous material 206 is configured to scour the container or capture the particles. The protrusions 104 may clean a container on a macro-basis to remove larger particulate, and the porous material 206 may finely scrub the container to remove smaller particulate.

Figure 3:
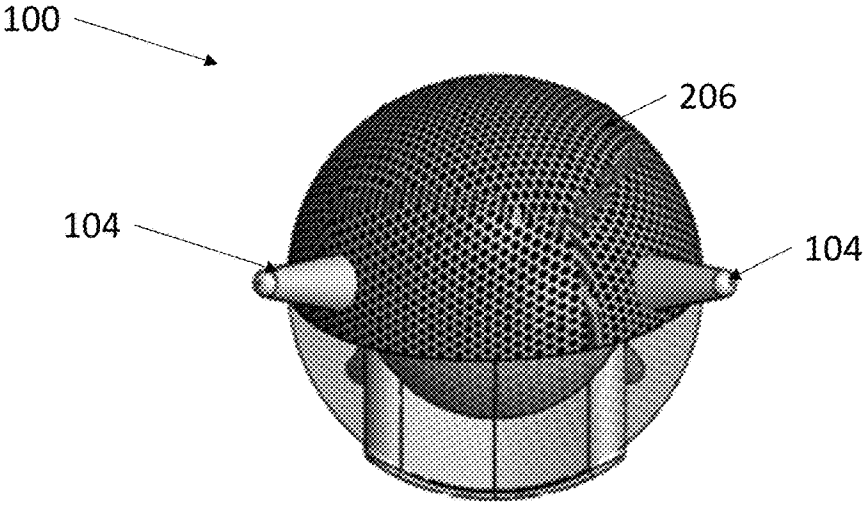
FIG. 3 is a partial cutaway side view of an example cleaning assembly, in accordance with various aspects of the present disclosure.

The protrusions 104 may extend past an outermost portion of the porous material 206 as shown in FIG. 3. The combination of the protrusions 104 and the porous material provide multiple cleaning surfaces. The porous material 206 may be configured to scour the surface to be cleaned and capturing particles of food or residue to be removed and the protrusions 104 may be configured to rub the surface to be cleaned and dislodging particles of food or residue from the surface to be cleaned.

Figure 4:
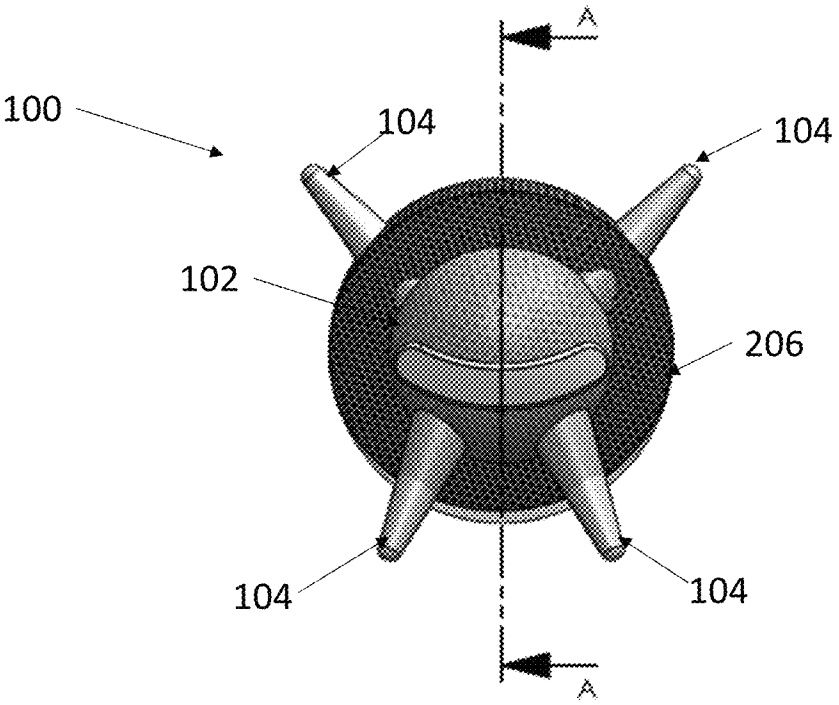
FIG. 4 is a partial cutaway back view of an example cleaning assembly, in accordance with various aspects of the present disclosure.

FIG. 4 is a partial cutaway back view of an example cleaning assembly 100, in accordance with various aspects of the present disclosure. As discussed in detail above, the cleaning assembly 100 includes a base 102 and a plurality of protrusions 104. The cleaning assembly 100 also includes a porous material 206. The porous material 206, which may be a sponge structure, is about the circumference of the base 102 and between the plurality of protrusions 104.

As shown in FIG. 4, the protrusions 104 may extend outwardly at a greater angle on a top side of the base 102 than the protrusions 104 arranged on a bottom side of the base 102. For example, the protrusions 104 extending from the top side of the base 102 may be spread further outwardly than the protrusions 104 extending from the bottom side of the base 102. In certain instances, a lesser number of the plurality of protrusions 104 are arranged on a first (upper) side of the circumference of the base 102 than on an opposing second (bottom) side of the circumference of the base 102.

In certain instances, the base 102 may include a first material and a second material with one of the materials having a greater weight than the other. The second material may have a greater weight than the first material. The first material and the second material may be molded, adhered, or coupled together to form the base. In certain instances, the second material is arranged within and surrounded by the first material. The weighted base 102 may facilitate cleaning of a container as explained in further detail below. In certain instances, the weighted base 102 may allow for the cleaning assembly 100 to not include the plurality of protrusions 104. The cleaning assembly 100 may clean objects without the need for the plurality of protrusions 104 in certain instances due to the weight and flexibility of the porous material 206.

Figure 5:
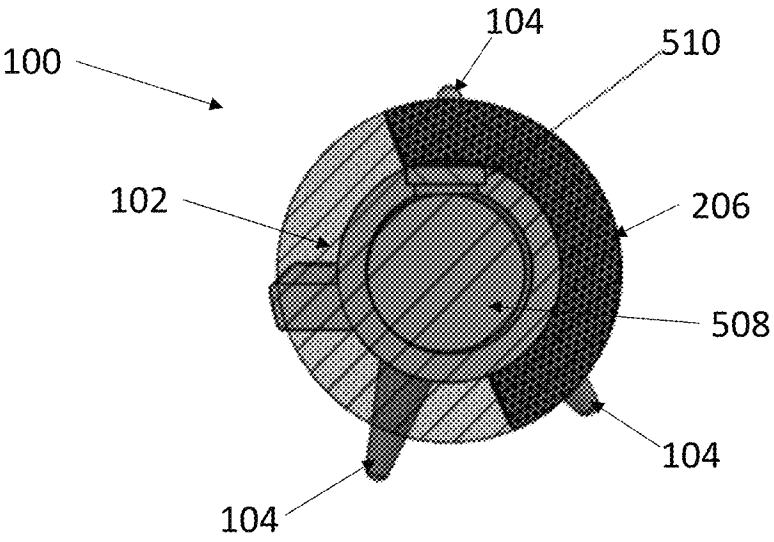
FIG. 5 is a cutaway view of the cleaning assembly shown in FIG. 4, in accordance with various aspects of the present disclosure.

FIG. 5 is a cutaway view along the along the A-A line of the cleaning assembly 100 shown in FIG. 4, in accordance with various aspects of the present disclosure. In certain instances, the protrusions 104 are configured to remove particles from the container and the porous material 206 is configured to scour the container or capture the particles. The protrusions 104 may clean a container on a macro-basis to remove larger particulate, and the porous material 206 may finely scrub the container to remove smaller particulate.

Figure 6:
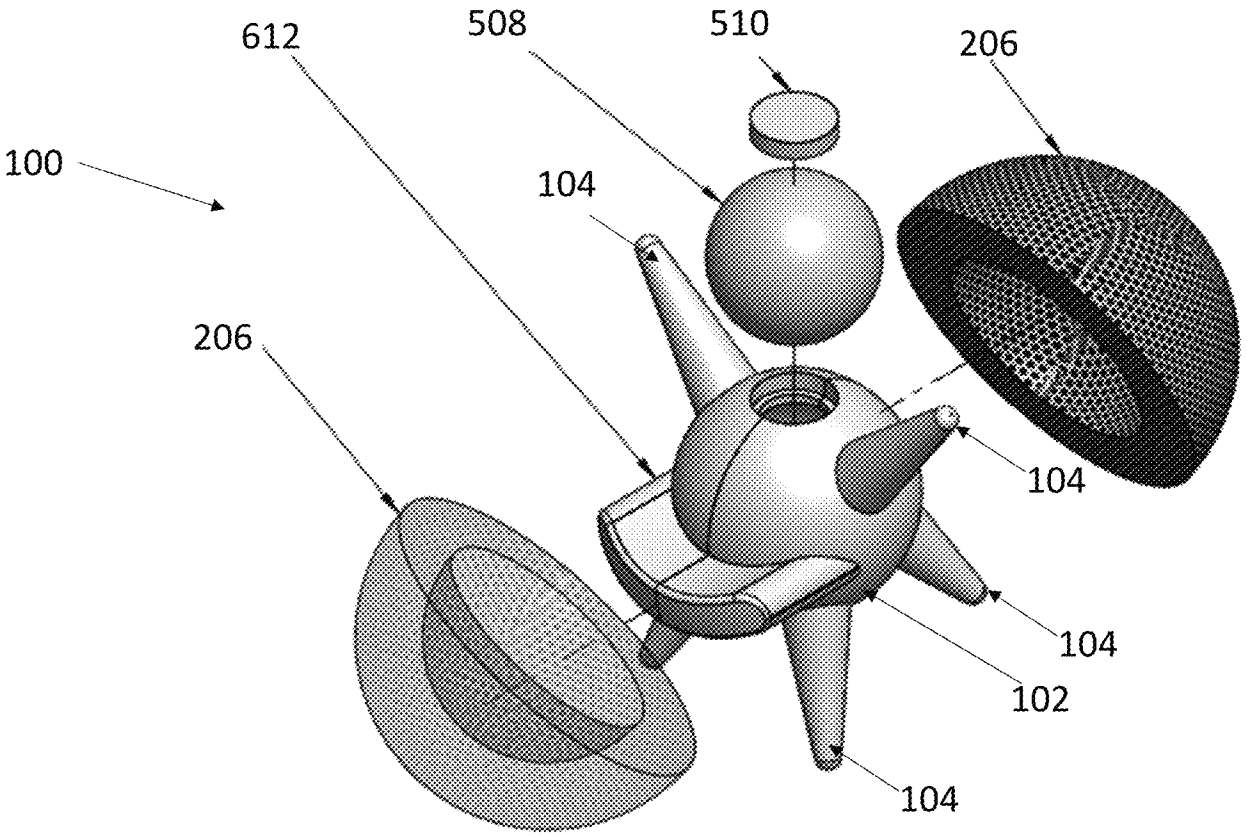
FIG. 6 is an exploded view of the cleaning assembly shown in FIGS. 4-5, in accordance with various aspects of the present disclosure.

In addition and as shown, the base 102 may include a weight 508 arranged within the base configured to facilitate contact between the plurality of protrusions 104 and the porous material 206 and the container. The weight 508 may ensure that the protrusions 104 and the porous material 206 contact the container interior when the cleaning assembly 100 is shaken or otherwise moved within the container. FIG. 6 is an exploded view of the cleaning assembly 100 shown in FIGS. 4-5, in accordance with various aspects of the present disclosure.

As shown in FIG. 5 and FIG. 6, a plug 510 may seal the weight 508 within the base 102. In addition, the base 102 may also include an outwardly extending lip portion 612 configured to support the porous material 206. In certain instances, the porous material 206 may be arranged in multiple pieces prior to be coupled, adhered, or bonded to the base 102.

To use the cleaning assembly 100 to clean a container, the cleaning assembly 100 may be placed or arranged within the container. A user may shake the container to manipulate the cleaning assembly and facilitate contact between the cleaning assembly 100 and the container to remove particles from the container.

In certain instances, the mass of the cleaning assembly 100 facilitates a "hands free" cleaning. The mass of the cleaner is sufficient to cause the cleaning assembly 100, when shaken, to strike the interior surface of the container with a sufficient force to effect the cleaning. In addition, the mass of the cleaner allows the porous material 206 to travel throughout the container, which may be partially filled with water or cleaning solution, while applying the cleaning force to the surface being cleaned. The cleaning force may be sufficient to deform the porous material 206 and protrusions 104 when those portions of the cleaning assembly 100 strike the interior surface of the container during the shaking of the container.

In operation, the user places one or more cleaning assemblies 100 into the container to be cleaned, and closes the container. The user may add soap and water, or a suitable cleaning solution. Soapy water or cleaning solution filled to about 20% of the container's volume was found to be an effective amount. The relative amount of water or cleaning solution to be used may be varied depending on the relative size of the cleaner and dimensions of the container. To clean, the operator shakes the container with one or more of the cleaning assemblies 100 inside. In practice, the duration of shaking may be between 5 and 30 seconds.

The cleaning assembly 100 allows the operator to clean the interior of the container in its entirety without the need to fold the user's hand or apply excessive force. The weight of the cleaning assembly 100 provides a force that is sufficient to scrub and clean (e.g., to break up the food particles or residue, as well as remove any biofilm) the surface and crevices of the container's interior. This process is generally faster for the operator than conventional cleaning techniques and in some instances requires less hand strength. Separately, the user may grasp a cleaning assembly 100 or attach a handle extension to the cleaner and use the cleaner as a manual scrubbing tool to remove any remaining residue.

In certain instances, the weight 508 can range from around 4 grams to 35 grams, with a suitable weight being selected for the size of the cleaner and size of the container. The size of the weight 508 can range from 10-20 mm in diameter and will likewise vary depending on the size of the cleaner. In other instances, the weight 508 may be omitted and the base 102 may have a suitable size and weight to enable the cleaning force. In certain instances, the base 102 may be an elastomeric material such as silicone. In some examples, the silicone has a hardness of 50-60 Durometer, Shore A. The porous material 206 may have a thickness that is between 7-9 mm according to some examples, with a particular example having a thickness between 7.6-8 mm. FIG. 5 illustrates various aspects. In related embodiments, the core structure includes one or more protrusions such as the conical spikes or planar extensions depicted in FIG. 1, or others as described in the examples discussed above. The protrusions 104 may have other non-conical shapes in other instances.

In certain instances, the cleaner assembly 100 may include a mechanical coupling that serves to attach the cleaner assembly 100 to a detachable handle. The mechanical coupling may include a threaded bore in the weight, which may be blind or through-hole. the detachable handle may include a mating threaded screw to engage with the threaded bore. In another example, the mechanical coupling may include a snap-in or friction-fit coupling, a bayonet connector part (male or female), a hook, an eyelet, or other structure to which a mating coupling on the handle may be attached.

The porous material 206 may be made from an open-cell foam material. A foam having around 10 pores per inch (PPI) may be suitable for most applications, though various other foams, synthetic, or natural fibrous materials may be used. In some embodiments, the porous material 206 may be 7-8 mm thick, which was found to be effective for absorbing and carrying a soapy solution, and providing a scrubbing effect against the surface to be cleaned.

In an example embodiment, the porous material 206 is formed from S-10 foam, having 10 pores per inch (ppi), a density of 1.9 lbs/cu.ft., 25% CFD (psi) 0.45, tensile strength (psi) of 16, elongation percent of 170, tear strength (lbs/inch) of 4.5, compression set at 50% Deflection of 15, and a volumetric air flow rate of 23.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A cleaning assembly for a container, the cleaning assembly comprising:

a base;

protrusions extending from different locations about a circumference of the base, the protrusions each tapering inwardly toward a distal end thereof; and a porous material arranged about the circumference of the base and between the protrusions, wherein the protrusions extend through the porous material, wherein the base includes a first material and a second material, and the second material is of a greater weight than the first material, wherein the second material is arranged within and surrounded by the first material.

2. The cleaning assembly of claim 1, wherein the first material of the base and the protrusions are formed of a common material different from the porous material.

3. The cleaning assembly of claim 2, wherein the first material of the base and the protrusions are formed of silicone.

4. The cleaning assembly of claim 1, wherein each of the protrusions are cone shaped.

5. The cleaning assembly of claim 1, wherein the base includes an outwardly extending lip portion configured to support the porous material.

6. The cleaning assembly of claim 1, wherein the porous material has a thickness of 7-9 mm.

7. The cleaning assembly of claim 1, wherein the protrusions extend from the base from respective proximal ends to the respective distal ends, wherein the porous material is arranged between the respective proximal ends and the respective distal ends.

8. The cleaning assembly of claim 1, wherein the porous material completely surrounds respective entire outer circumferences of the protrusions between the respective proximal ends and the respective distal ends.

9. The cleaning assembly of claim 1, wherein the porous material has an outer circumference that is greater than the circumference of the base.

10. A cleaning assembly for a container, the cleaning assembly comprising:

a base;

protrusions each extending from respective proximal ends at different locations about a circumference of the base and configured to remove particles from the container, the protrusions each tapering inwardly toward respective distal ends thereof; and a porous material arranged between the respective proximal ends and the respective distal ends and between the protrusions and configured to scour the container and/or capture the particles; and a weight arranged within the base configured to facilitate contact between the protrusions and the porous material and the container, wherein the protrusions extend through openings in the porous material.

11. The cleaning assembly of claim 10, wherein a lesser number of the protrusions are arranged on a first side of the circumference of the base than on an opposing second side of the circumference of the base.

12. The cleaning assembly of claim 10, wherein the base and the protrusions are formed of a common material.

13. The cleaning assembly of claim 12, wherein the base and the protrusions are formed of silicone.

14. The cleaning assembly of claim 10, wherein each of the protrusions are cone shaped.

15. The cleaning assembly of claim 10, wherein the porous material has a thickness of 7-9 mm.

16. The cleaning assembly of claim 10, wherein the weight weights 4-35 grams.

17. The cleaning assembly of claim 10, wherein the porous material completely surrounds respective entire outer circumferences of the protrusions between the respective proximal ends and the respective distal ends.

18. A cleaning assembly for a container, the cleaning assembly comprising:

a base including an outwardly extending lip portion;

a plurality of protrusions extending from different locations about a circumference of the base, the plurality of protrusions each tapering inwardly toward a distal end thereof; and a porous material arranged about the circumference of the base and between the plurality of protrusions, wherein the outwardly extending lip portion is configured to support the porous material.

* * * * *